US012560361B2

(12) United States Patent
Lee et al.

(10) Patent No.: US 12,560,361 B2
(45) Date of Patent: Feb. 24, 2026

(54) EVAPORATIVE CONDENSER

(71) Applicant: KYUNGDONG NAVIEN CO., LTD., Pyeongtaek-si (KR)

(72) Inventors: Ju Hyuk Lee, Seoul (KR); Geon Young Kim, Seoul (KR); Chan Woo Nam, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 135 days.

(21) Appl. No.: 18/541,742

(22) Filed: Dec. 15, 2023

(65) Prior Publication Data

US 2024/0219084 A1 Jul. 4, 2024

(30) Foreign Application Priority Data

Dec. 29, 2022 (KR) ..... 10-2022-0188867
Jul. 19, 2023 (KR) ..... 10-2023-0094000

(51) Int. Cl.
*F25B 39/04* (2006.01)
*F28D 1/053* (2006.01)
*F28F 9/02* (2006.01)

(52) U.S. Cl.
CPC ..... *F25B 39/04* (2013.01); *F28D 1/05366* (2013.01); *F28F 9/02* (2013.01); *F25B 2339/041* (2013.01); *F28D 1/05391* (2013.01); *F28F 2009/0285* (2013.01)

(58) Field of Classification Search
CPC ..... F25B 2339/041; F25B 39/04; F28D 1/05391; F28F 9/0221
See application file for complete search history.

(56) References Cited

U.S. PATENT DOCUMENTS

2004/0251014 A1* 12/2004 Petersen ..... F28D 1/05375 165/173
2016/0375744 A1* 12/2016 Kakizaki ..... B60H 1/00328 62/160
2021/0131749 A1* 5/2021 Park ..... F28F 1/126
2021/0325118 A1* 10/2021 Shen ..... F28D 7/1607

FOREIGN PATENT DOCUMENTS

KR 20220074472 6/2022
WO WO-2006059783 A1 * 6/2006 ..... F28F 9/0214

* cited by examiner

*Primary Examiner* — Paul Alvare
(74) *Attorney, Agent, or Firm* — Dority & Manning, P.A.

(57) ABSTRACT

A condenser includes first to third header rows, including a first header extending in a first direction and having a flow path therein, a second header extending in the first direction and having a flow path therein, and a plurality of connecting tubes extending in a second direction between the first and second headers and connecting flow paths of the first and second headers. The first to third header rows are stacked in a third direction, the first to third directions are orthogonal to each other, the 1-1 header and the 2-1 header are configured to communicate with each other, the 1-2 header, the 2-2 header and the 3-2 header are configured to communicate with each other, and at least one of the 1-1 header and the 2-1 header is provided with a plurality of fluid inlets connected to a fluid supply unit.

8 Claims, 11 Drawing Sheets

Ⅱ-Ⅱ'

Ⅲ-Ⅲ'

Ⅳ-Ⅳ'

V - V'

VI-VI'

VII-VII'

VIII-VIII'

EVAPORATIVE CONDENSER

CROSS-REFERENCE TO RELATED APPLICATION(S)

This application claims benefit of priority to Korean Patent Application No. 10-2022-0188867 filed on Dec. 29, 2022 and No. 10-2023-0094000 filed on Jul. 19, 2023 in the Korean Intellectual Property Office, the disclosure of which is incorporated herein by reference in its entirety.

BACKGROUND

1. Field

The present disclosure relates to an evaporative condenser, and more particularly, to an evaporative condenser having improved condensation efficiency.

2. Description of Related Art

A condenser is a heat exchanger cooling and liquefying high-temperature, high-pressure refrigerant vapor supplied from a compressor, and serves to dissipate heat externally in a refrigeration cycle.

Such an evaporative condenser uses a combination of water cooling and air cooling, and is configured to spray water onto the tube through which the cooling fluid passes and to flow air supplied from the blower to the surface of the tube, and to cool the cooling fluid by discharging water vapor from the surface of the tube.

Patent Document 1 discloses an evaporative condenser.

In the case of Patent Document 1, a three-dimensional structure in which header rows are stacked is disclosed. In the case of such a structure, the fluid is distributed to a plurality of header rows from the side of the inlet, and the number of header rows used is reduced toward the rear. However, in the case of this structure, the fluid supplied from the fluid inlet is divided into three directions and flows, and in this case, in the initially used header row, there is a problem in that the fluid does not flow smoothly to a location far from the inlet and may not be appropriately utilized for heat exchange.

(Patent Document 1) KR 10-2022-0074472 A

SUMMARY

An aspect of the present disclosure is to provide an evaporative condenser in which heat exchange efficiency may be improved.

According to an aspect of the present disclosure, an evaporative condenser is provided as follows.

According to an aspect of the present disclosure, a condenser includes a first header row including a 1-1 header extending in a first direction and having a flow path therein, a 1-2 headers extending in the first direction and having a flow path therein, and a plurality of first connecting tubes extending in a second direction between the 1-1 header and the 1-2 header and connecting the flow paths of the 1-1 header and the 1-2 header; a second header row including a 2-1 header extending in the first direction and having a flow path therein, a 2-2 header extending in the first direction and having a flow path therein, and a plurality of second connecting tubes extending in the second direction between the 2-1 header and the 2-2 header and connecting the flow paths of the 2-1 header and the 2-2 header; and a third header row including a 3-1 header extending in the first direction and having a flow path therein, a 3-2 header extending in the first direction and having a flow path therein, and a plurality of third connecting tubes extending in the second direction between the 3-1 header and the 3-2 header and connecting the flow paths of the 3-1 header and the 3-2 header. The first to third header rows are stacked in a third direction, the first to third directions are orthogonal to each other, the 1-1 header and the 2-1 header are configured to communicate with each other, the 1-2 header, the 2-2 header and the 3-2 header are configured to communicate with each other, and at least one of the 1-1 header and the 2-1 header is provided with a plurality of fluid inlets connected to a fluid supply unit.

The plurality of fluid inlets may include a first fluid inlet and a second fluid inlet, the first fluid inlet is provided on one end of the 1-1 header in the first direction, and the second fluid inlet is provided on the other end of the 1-1 header in the first direction.

The condenser may include a first baffle plate disposed across the 1-1 header and the 2-1 header, between the first fluid inlet and the second fluid inlet, and the first baffle plate may include a first through-hole disposed in a position corresponding to the 1-1 header and a second through-hole disposed in a position corresponding to the 2-1 header.

The first through-hole may have a cross-sectional area smaller than a cross-sectional area of the 1-1 header, and the second through-hole may have a cross-sectional area smaller than a cross-sectional area of the 2-1 header. The first baffle plate may be disposed to be spaced apart from the first fluid inlet and the second fluid inlet by the same distance.

The plurality of fluid inlets may include a first fluid inlet and a second fluid inlet, the first fluid inlet may connect one ends of the 1-1 header and the 2-1 header in the first direction to the fluid supply unit, and the second fluid inlet may connect the other ends of the 1-1 header and the 2-1 header in the first direction to the fluid supply unit.

The condenser may further include a fourth header row including a 4-1 header extending in the first direction and having a flow path therein, a 4-2 header extending in the first direction and having a flow path therein, and a plurality of fourth connecting tubes extending in the second direction between the 4-1 header and the 4-2 header and connecting the flow paths of the 4-1 header and the 4-2 header, Fluid flow directions in the first connecting tube and the second connecting tube may be the same, and a fluid flow direction in the third connecting tube may be opposite to a fluid flow direction in the first connecting tube.

The 3-1 header may be configured to communicate with the 4-1 header for only one section in the first direction, and a second baffle plate may be disposed on the 4-1 header, to divide the one section from other section. The second baffle plate may be disposed on the 3-1 header, and may include a third through-hole having a cross-sectional area smaller than a cross-sectional area of the 3-1 header in a position corresponding to the 3-1 header.

The second baffle plate may be disposed biased to one side in the first direction in the 4-1 header such that a length of a portion communicating with the 3-1 header is longer than a length of the other portion, and the other section of the 4-1 header may be connected to a fluid outlet.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Hereinafter, detailed embodiments will be described with reference to the accompanying drawings. However, the spirit of the present disclosure is not limited to the presented examples, and those skilled in the art who understand the spirit of the present disclosure may easily suggest other degenerative inventions or other embodiments included in the scope of the present disclosure through the addition, change, or deletion of other components within the scope of the same spirit, and this will also be included within the scope of the spirit of the present disclosure.

In addition, throughout the specification, it means that a component being 'connected' to another component includes not only the case where these components are 'directly connected', but also the case where they are 'indirectly connected' through other components. In addition, 'including' a certain component means that other components may be further included, rather than excluding other components unless otherwise specified.

FIGS. 1 to 10 illustrate an evaporative condenser according to an embodiment.

Figure 1:
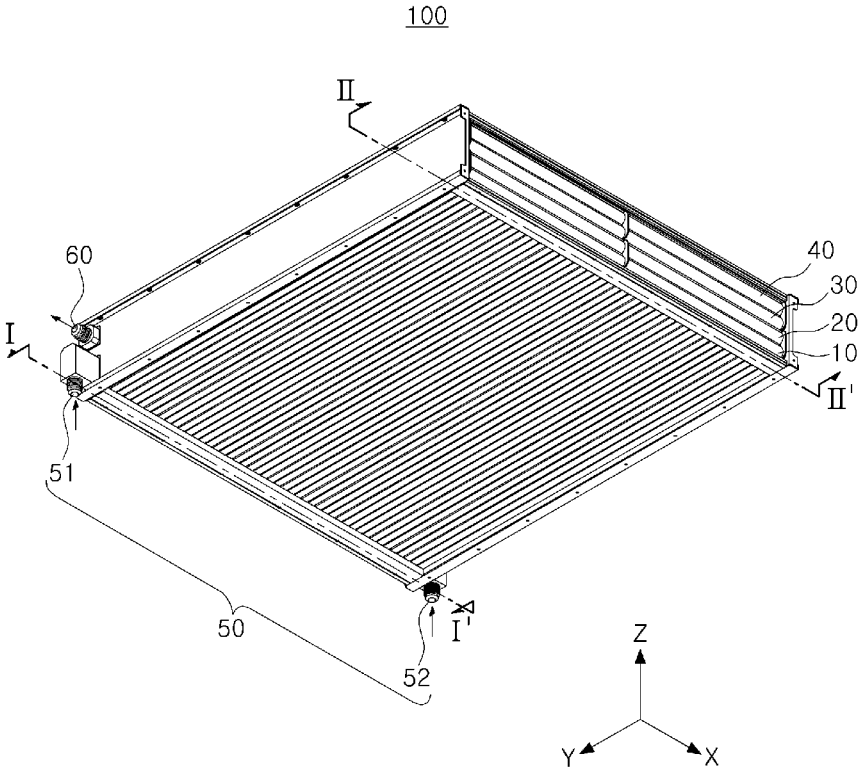
FIG. 1 is a bottom perspective view of an evaporative condenser according to an embodiment.
Figure 2:
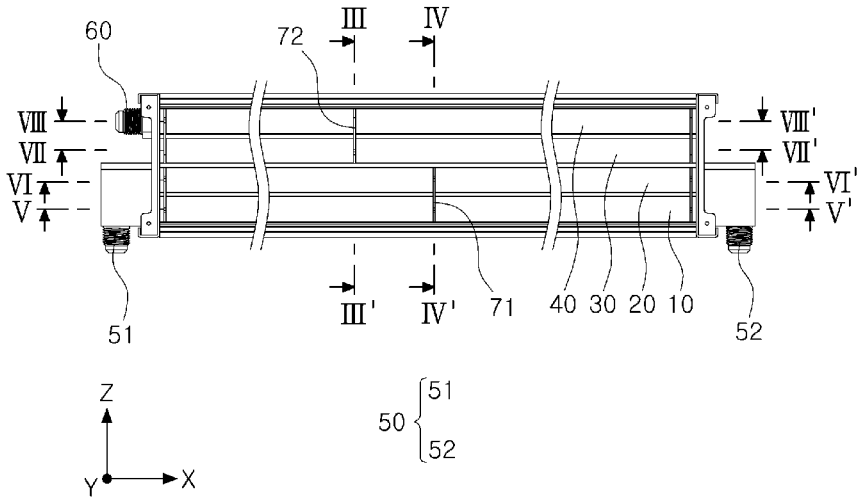
FIG. 2 is a side view of an evaporative condenser according to an embodiment.
Figure 3:
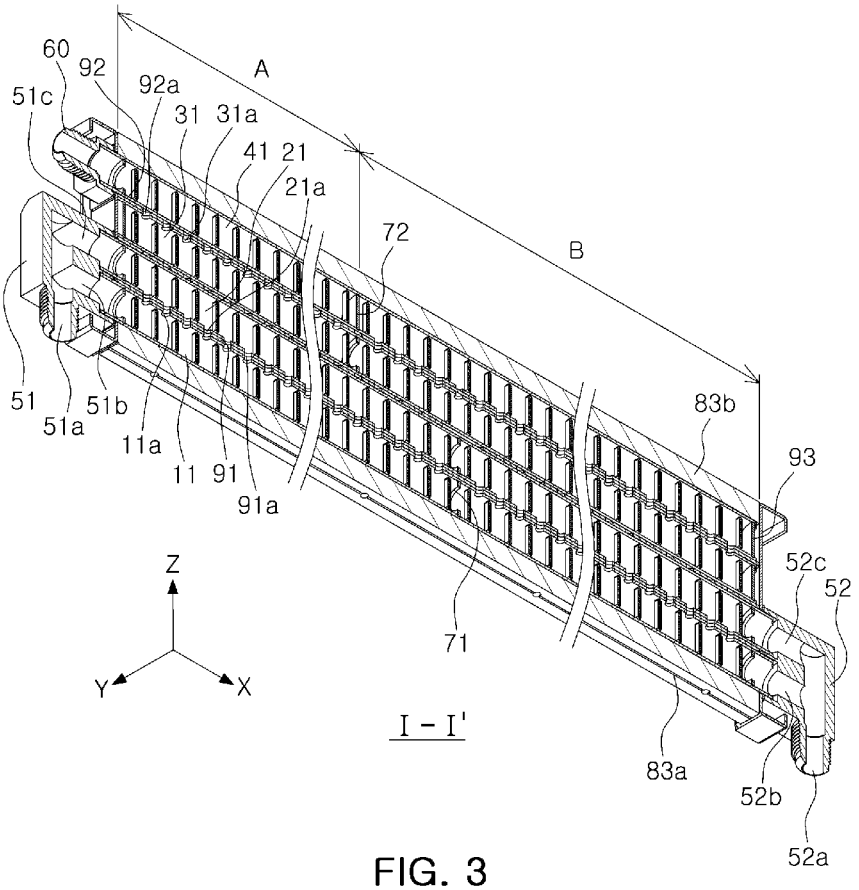
FIG. 3 is a schematic perspective view taken along line I-I' of FIG. 1.
Figure 4:
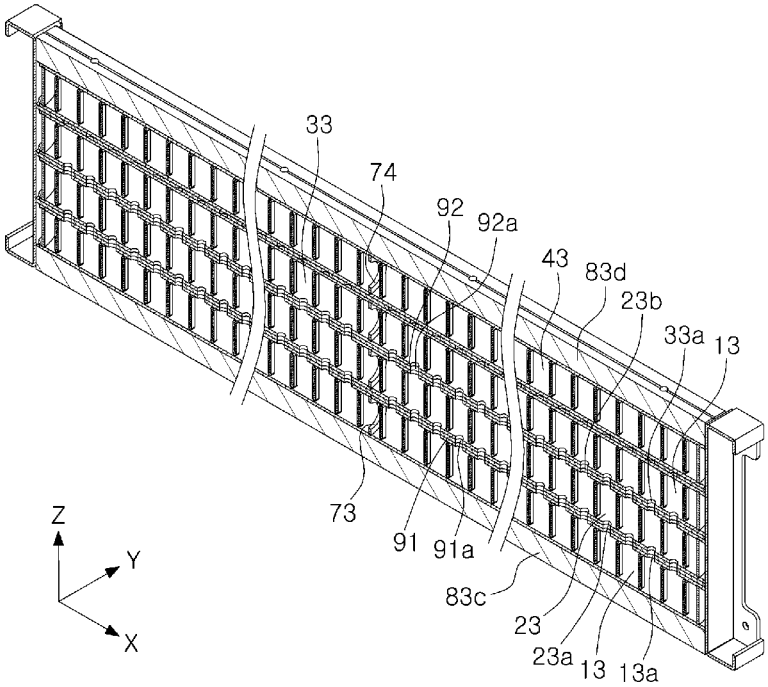
FIG. 4 is a schematic perspective view of FIG. 1, taken along line II-II'.
Figure 5:
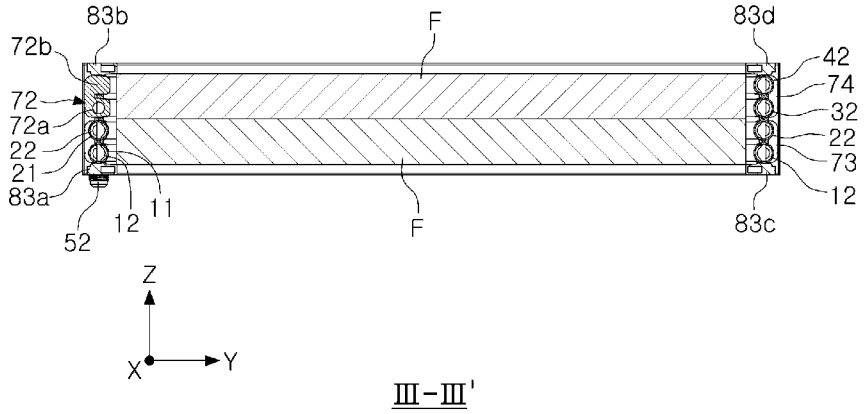
FIG. 5 is a cross-sectional view taken along line III-III' of FIG. 2.
Figure 6:
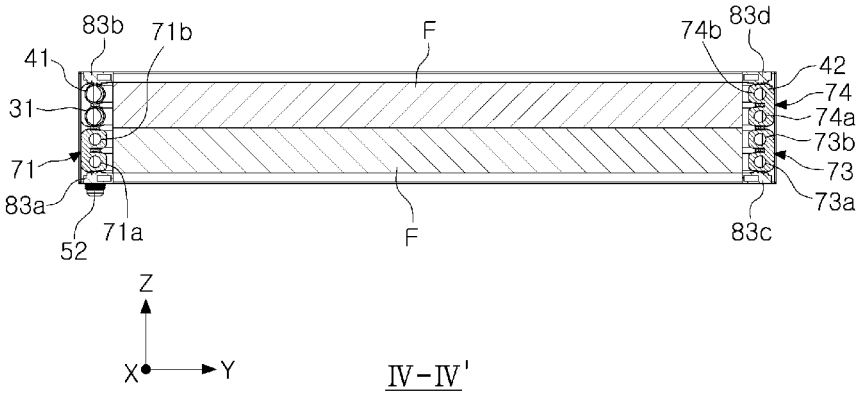
FIG. 6 is a cross-sectional view of FIG. 2 taken along line IV-IV'.
Figure 7:
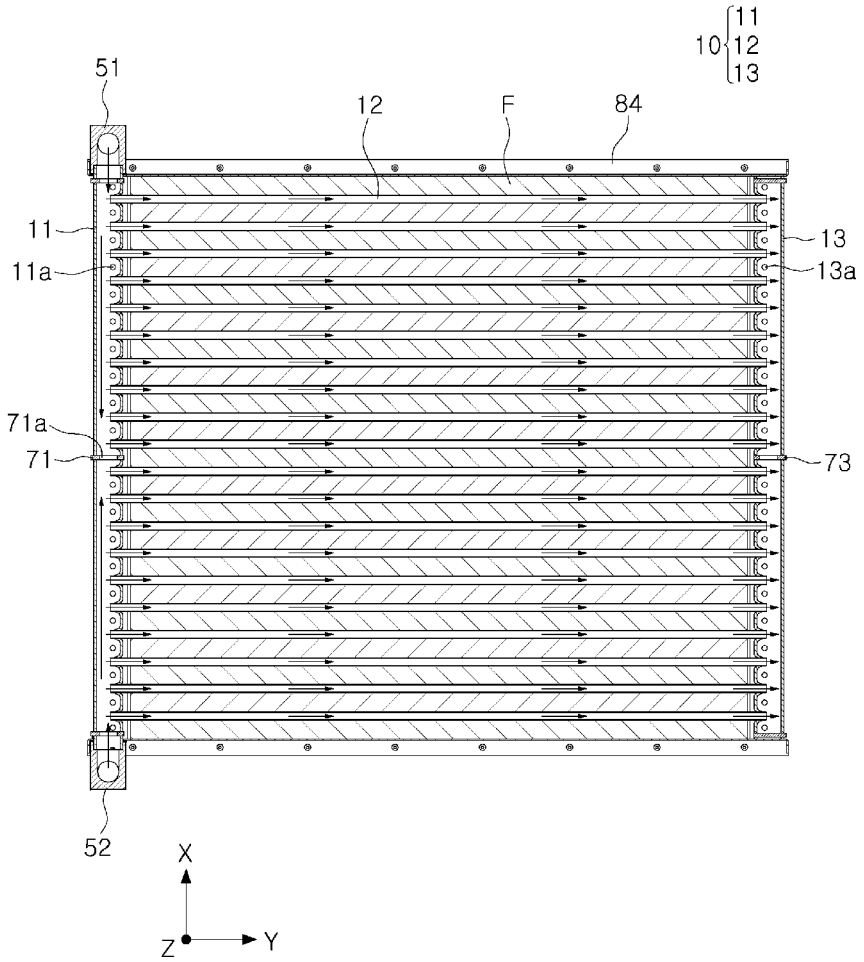
FIG. 7 is a cross-sectional view of FIG. 2 taken along line V-V'.
Figure 8:
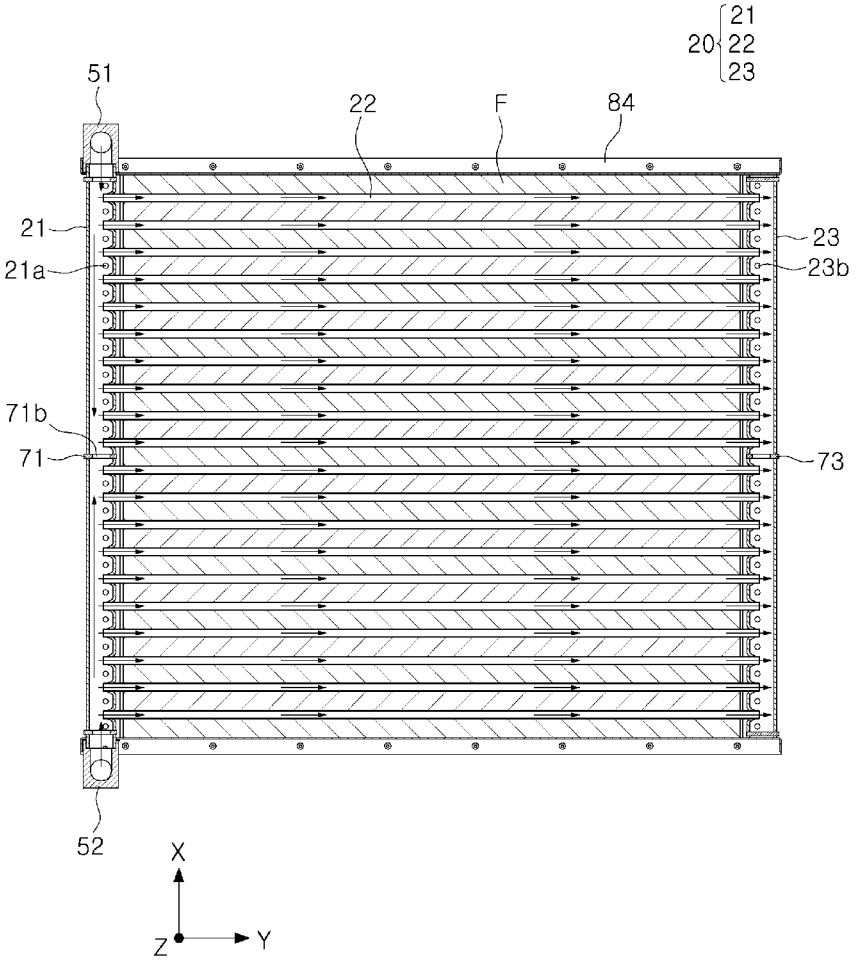
FIG. 8 is a cross-sectional view of FIG. 2 taken along line VI-VI'.
Figure 9:
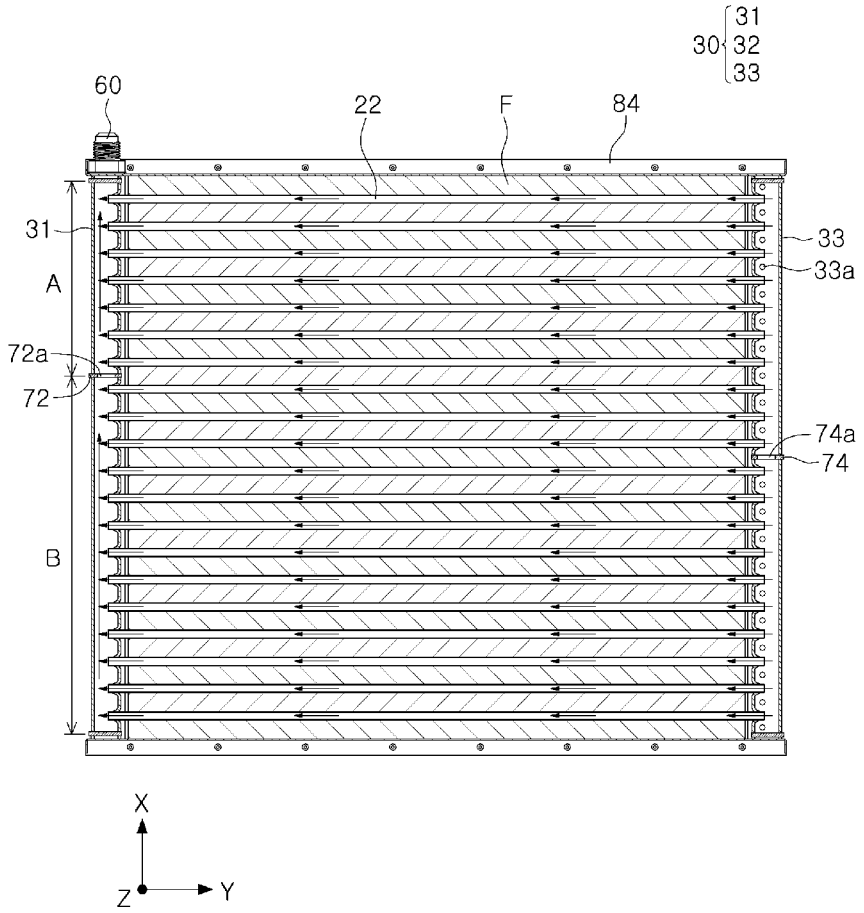
FIG. 9 is a cross-sectional view of FIG. 2 taken along line VII-VII'.
Figure 10:
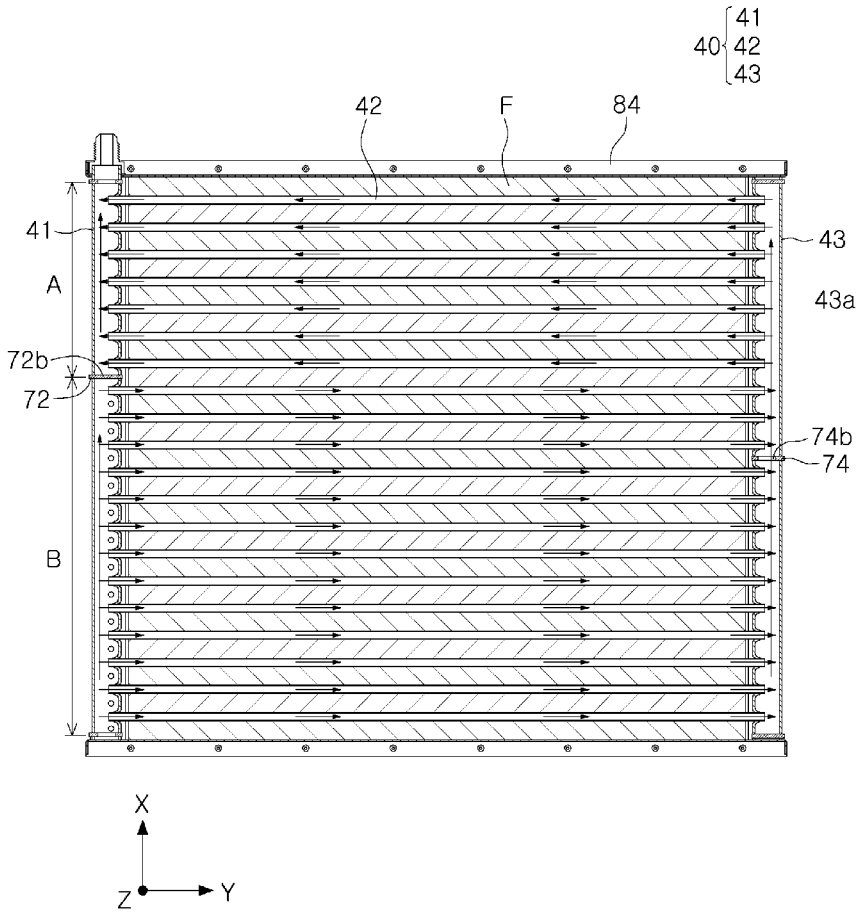
FIG. 10 is a cross-sectional view of FIG. 2 taken along line VIII-VIII'.

In detail, FIG. 1 is a bottom perspective view of an evaporative condenser according to an embodiment, FIG. 2 is a side view of an evaporative condenser according to an embodiment, FIGS. 3 and 4 illustrate perspective cross-sectional views taken along lines II' and II-II' of FIG. 1, and FIGS. 5 to 10 are cross-sectional views taken along lines III-III', IV-IV', V-V', VI-VI', VII-VII' and VIII-VIII' of FIG. 2.

An evaporative condenser 100 according to an embodiment includes a plurality of header rows 10, 20, 30, and 40, a fluid inlet 50 and a fluid outlet 60 connected to the header rows. In the present embodiment, the evaporative condenser 100 having first to fourth header rows 10, 20, 30, and 40 is described, but the number of header rows 10, 20, 30, and 40 is not limited and may be applied as long as it is 3 or more.

The first to fourth header rows 10, 20, 30, and 40 respectively include first headers 11, 21, 31 and 41 extending in a first direction (X) and having a flow path therein, second headers 13, 23, 33 and 43 extending in the first direction (X), spaced apart from the first headers 11, 21, 31 and 41 and having a flow path therein, and a plurality of first to fourth connecting tubes 12, 22, 32 and 42 extending in a second direction (Y) between the first headers 11, 21, 31 and 41 and the second headers 13, 23, 33 and 43 and connecting the flow paths of the first headers 11, 21, 31 and 41 and the second headers 13, 23, 33 and 43.

In detail, in the present embodiment, the first header row 10 includes a 1-1 header 11 extending in the first direction (X), a 1-2 header 13 extending in the first direction (X) in a position spaced apart from the 1-1 header 11 in the second direction, and a plurality of first connecting tubes 12 connecting the 1-1 header 11 and the 1-2 header 13. The first connecting tube 12 extends to the insides of the 1-1 header 11 and the 1-2 header 12, and thus, the 1-1 header 11, the 1-2 header 13 and the first connecting tube 12 are configured to communicate with each other.

Similarly, the second header row 20 includes a 2-1 header 21 extending in the first direction (X), a 2-2 header 23 extending in the first direction (X) in a position spaced apart from the 2-1 header 21 in the second direction, and a plurality of second connecting tubes 22 connecting the 2-1 header 21 and the 2-2 header 23. The second connecting tube 22 extends to the insides of the 2-1 header 21 and the 2-2 header 23, and the 2-1 header 21, the 2-2 header 23 and the second connecting tube 22 are configured to communicate with each other.

The third header row 30 and the fourth header row 40 also have the same structure. The third header row 30 includes a 3-1 header 31, a 3-2 header 33 and a third connecting tube 32, and the fourth header row 40 includes a 4-1 header 41, a 4-2 header 43 and a fourth connecting tube 42.

The first to fourth header rows 10, 20, 30, and 40 are stacked in the third direction (Z) which is the height direction. For example, the second header row 20 is connected on the first header row 10, the third header row 30 is stacked on the second header row 20 and the fourth header row 40 is stacked on the third header row 30. Thus, the evaporative condenser 100 having a substantially rectangular parallelepiped structure is configured.

A connection block 92 is disposed between the header rows 10, 20, 30, and 40, and the connection block 92 has curved surfaces corresponding to the headers 11, 13, 21, 23, 31, 33, 41, and 43 of the header rows 10, 20, 30, and 40 on the upper and lower portions to facilitate stacking of the headers 11, 13, 21, 23, 31, 33, 41 and 43 having a curved surface. Through-holes 92*a* are formed in the third direction where fluid flow is required between the upper and lower headers in the connection block 92.

In each of the headers 11, 13, 21, 23, 31, 33, 41, and 43, an end not connected to the fluid inlet 50 or the fluid outlet 60 is closed with an end plate 95 (see FIG. 3), and through-holes 11*a*, 13*a*, 21*a*, 23*a*, 31*a*, 33*a*, 41*a* and 43*a* are formed in one or both sides of respective headers 11, 13, 21, 23, 31, 33, 41 and 43 in the third direction (Z). Thus, a fluid path, through which the fluid introduced through the connection tubes 12, 22, 32, and 42 flows into the headers 11, 13, 21, 23, 31, 33, 41, and 43, and the fluid is introduced into the next header 11, 13, 21, 23, 31, 33, 41, and 43, or the fluid introduced into the headers 11, 13, 21, 23, 31, 33, 41 and 43 moves to the connecting tubes 12, 22, 32 and 42, is formed.

Cases 83*a*, 83*b*, 83*c*, and 83*d* are formed at corners or sides of the evaporative condenser 100 to hold the stacked header rows 10, 20, 30, and 40.

Baffle plates 71, 72, 73, and 74 are disposed at a predetermined distance on the ends of the headers 11, 13, 21, 23, 31, 33, 41, and 43 in the first direction (X). In the present embodiment, a first baffle plate 71 disposed across the 1-1 header 11 and the 2-1 header 21, a second baffle plate 72 disposed across the 3-1 header 31 and the 4-1 header 41, a third baffle plate 73 disposed across the 1-2 header 13 and a 2-2 header 23, and a fourth baffle plate 74 disposed across the 3-2 header 33 and the 4-2 header 43 are included.

In the first to fourth baffle plates 71, 72, 73, and 74, through-holes 71*a*, 71*b*, 72*a*, 73*a*, 73*b*, 74*a* and 74*b* are formed when the headers 11, 13, 21, 23, 31, 33, 41 and 43 need to allow fluid flow in the first direction (X), and to block the fluid flow, the first to fourth baffle plates 71, 72, 73, and 74 are configured to include a blocking portion 72*b*. Whether to flow in the first direction (X) in a specific position of the headers 11, 13, 21, 23, 31, 33, 41 and 43 through the baffle plates 71, 72, 73 and 74 is determined, and the bonding force of the headers 11, 13, 21, 23, 31, 33, 41, and 43 is increased, and the area of the through-holes 71*a*, 71*b*, 72*a*, 73*a*, 73*b*, 74*a*, and 74*b* is formed to be smaller than a cross-sectional area of the headers 11, 13, 21, 23, 31, 33, 41 and 43, such that the baffle plates 71, 72, 73, and 74 may supplement rigidity of the headers 11, 13, 21, 23, 31, 33, 41, and 43.

In the present embodiment, in the evaporative condenser 100, the fluid inlet 50 includes a first fluid inlet 51 and a second fluid inlet 52, the first fluid inlet 51 is connected to the 1-1 header 11 and the 2-1 header 21 on one side in the first direction X, and the second fluid inlet 52 is connected to the 1-1 header 11 and the 2-1 header 21 on the other side in the first direction X.

Although not illustrated, the first fluid inlet 51 and the second fluid inlet 52 are connected to a fluid supply unit (not illustrated), for example, such that fluid supplied from a compressor is branched and supplied.

The first fluid inlet 51 is formed in a structure having one inlet 51*a* and two outlets 51*b* and 51*c*, and the fluid flowing into the first fluid inlet 51 is supplied to one ends of the 1-1 header 11 and the 2-1 header 21. Similarly, the second fluid inlet 52 is formed in a structure having one inlet 52*a* and two outlets 52*b* and 52*c*, and the fluid flowing into the second fluid inlet 52 is supplied to the other ends of the 1-1 header 11 and the 2-1 header 21.

The first baffle plate 71 is disposed in the middle between the 1-1 header 11 and the 2-1 header 21 in the first direction X. For example, the distance from one end of the 1-1 header 11 to the first baffle plate 71 in the first direction X is equal to the distance from the other end of the 1-1 header 11 to the first baffle plate 71. In the first baffle plate 71, a through-hole 71*a* is positioned in a position corresponding to the 1-1 header 11 to allow fluid flow in the first direction (X). Similarly, a through-hole 71*b* is positioned in a position corresponding to the 2-1 header 21 in the first baffle plate 71 to allow fluid flow in the first direction (X).

The fluid outlet 60 is connected to the fourth header row 40, which is an uppermost header row, and is connected to one end of the 4-1 header 41 in the present embodiment.

In the present embodiment, by branching the fluid supplied to the evaporative condenser 100 and then supplying the fluid to both sides of the same header, initially, the high-temperature fluid is evenly supplied to the evaporative condenser 100, thereby improving the initial heat exchange area. Since heat exchange occurs more when the temperature difference is large, it is advantageous for heat exchange to have a wide heat exchange area in a high temperature state. In the present embodiment, the heat exchange efficiency is improved by supplying the fluid from both sides.

The fluid flow in the evaporative condenser 100 will be described with reference to FIGS. 7 to 10.

The fluid supplied from the fluid supply unit (not illustrated) is supplied to both sides of the 1-1 header 11 and the 2-1 header 21 through the first fluid inlet 51 and the second fluid inlet 52 of the fluid inlet 50, and then, passes through the first and second connecting tubes 12 and 22, and passes through the fin (F) disposed between the first and second connecting tubes 12 and 22, thereby increasing the heat exchange area. Since the heat exchange method of the evaporative condenser 100 is known in the existing, for example, Patent Document 1, a detailed description thereof will be omitted.

The fluid having passed through the first and second connecting tubes 12 and 22 flows into the 1-2 header 13 and the 2-2 header 23, passes through the through-holes 13*a*, 23*a*, and 23*b*, and flows into the 3-2 header 33. The fluid introduced into the 3-2 header 33 flows into the 3-1 header 31 through the third connecting tube 32. A second baffle plate 72 is disposed on the 3-1 header 31. The lengths of a first section (A) between the fluid outlet 60 and the second baffle plate 72 and a second section (B) between the second baffle plate 72 and the opposite side to the fluid outlet side are different, and the length of the first section (A) is shorter than the length of the second section (B). For example, the second baffle plate 72 is biased toward the fluid outlet 60. In the first section (A), a through-hole is not formed in at least one of the 3-1 header 31, the connection block 92, and the 4-1 header 41, to prevent fluid flow between the 3-1 header 31 and the 4-1 header 41. On the other hand, in the second section (B), through-holes 31*a* and 41*a* are formed to allow fluid flow between the 3-1 header 31 and the 4-1 header 41, and the fluid sequentially introduced into the third connecting tube 32 and the 3-1 header 31 rises to the second section B of the 4-1 header 41.

The fluid introduced into the second section (B) of the 4-1 header 41 moves to the 4-2 header 43 through the corresponding fourth connecting tube 42, flows from the 4-2 header 43 in the first direction (X) to the portion of the 4-2 header 43 corresponding to the first section (A), flows into the first section (A) of the 4-1 header 41 through the fourth connecting tube 42 corresponding to the first section (A), and exits from the 4-1 header 41 to the fluid outlet 60.

In the evaporative condenser 100 according to an embodiment of the present disclosure, the fluid requiring condensation is initially simultaneously supplied to both sides of the first and second header rows 10 and 20 in the first direction X, passes through the first and second header rows 10 and 20 at the same time, then passes through the third header row 40, the second section B of the fourth header row 40, and the first section A of the fourth header row 40, and then exits through exits into the fluid outlet. Therefore, as the temperature is lowered, the fluid passage area is reduced, thereby significantly reducing pressure loss and improving heat exchange efficiency.

Figure 11:
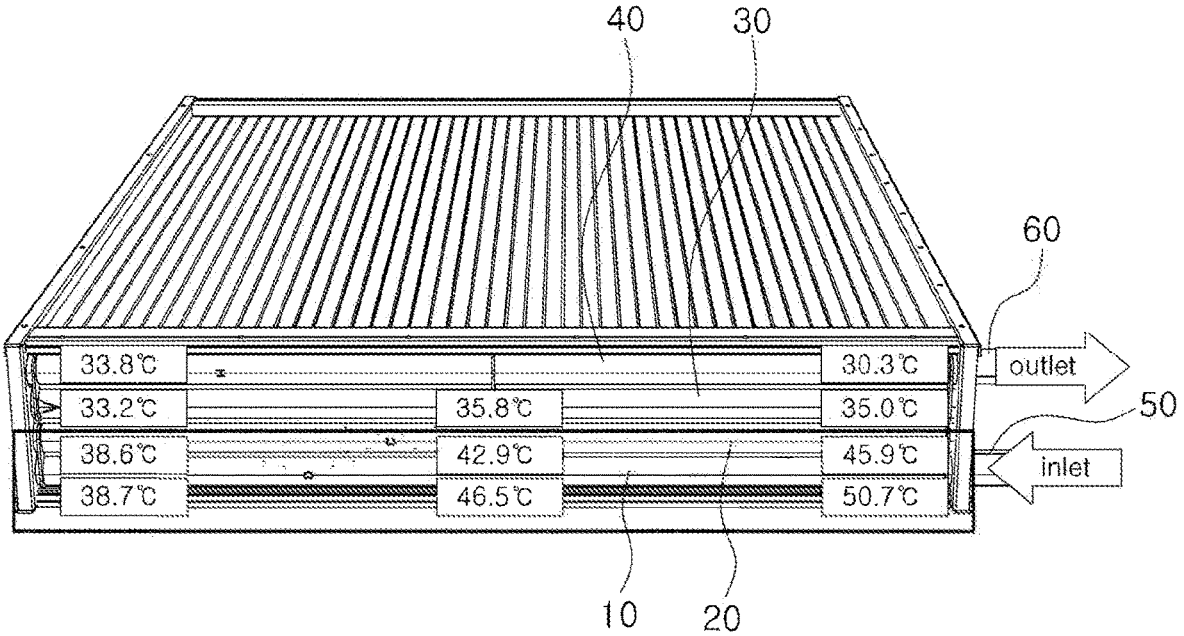
FIG. 11 is an image illustrating the temperatures of header rows in an evaporative condenser of a comparative example.
Figure 12:
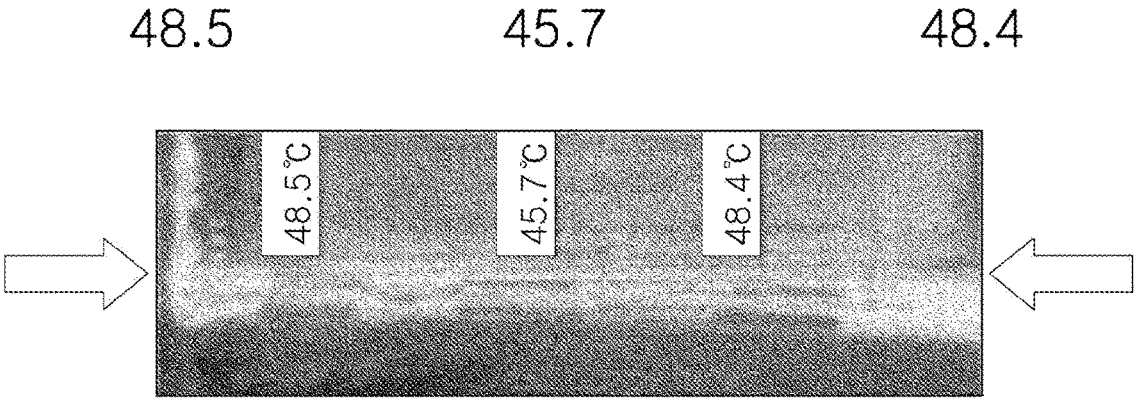
FIG. 12 is an image of a first header row in an evaporative condenser according to an embodiment, captured by a thermal imaging camera.

FIG. 11 illustrates an image providing the temperature in the related art, for example, the evaporative condenser of Patent Document 1, and FIG. 12 illustrates a picture of an evaporative condenser according to an embodiment, captured with a thermal imaging camera.

As illustrated in FIGS. 11 and 12, in the evaporative condenser of the related art, since the fluid is introduced from one fluid inlet 50, the opposite side of the fluid inlet 50 is lower in temperature than the fluid inlet 50, and since the fluid passes through the connecting tube in the lowered temperature state, the heat exchange efficiency is not good. On the other hand, as illustrated in FIG. 12, in the case of the present embodiment, the fluid inlet 50 is connected to both sides such that the heat exchange efficiency may be improved by passing through the connecting tube in a high temperature state.

Figure 13:
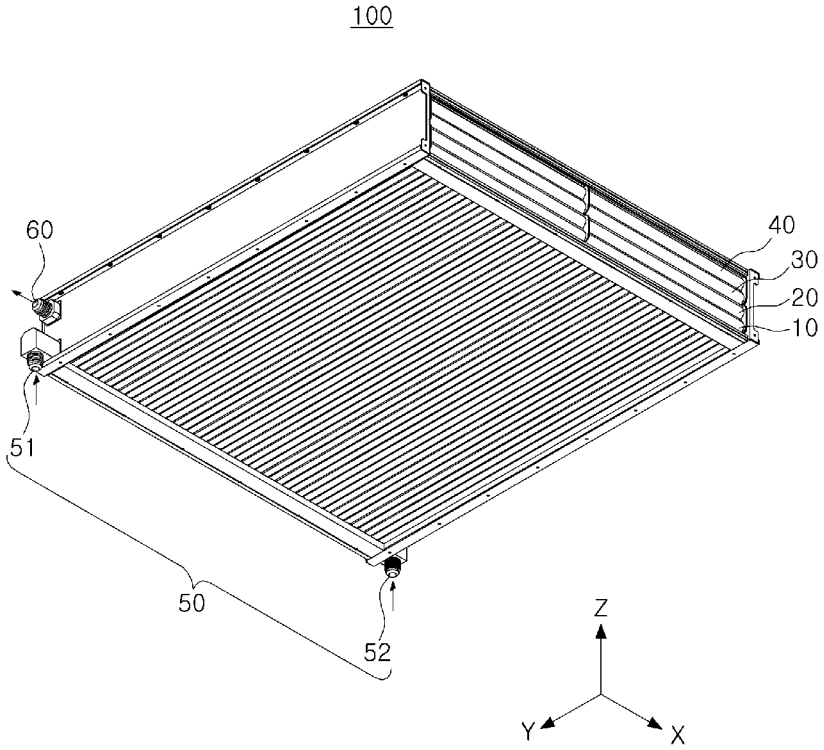
FIG. 13 is a bottom perspective view of an evaporative condenser according to another embodiment.

FIG. 13 illustrates an evaporative condenser 100 according to another embodiment.

In the case of the embodiment of FIG. 13, a flow path and the like are the same as those of the embodiment of FIGS. 1 to 10, and the only difference is that the fluid inlet 50 is connected only to the first header row 10, and to avoid duplication of explanation, only the differences are described.

In the embodiment of FIG. 13, the first fluid inlet 51 is connected to one side of the 1-1 header of the first header row 10 in the first direction (see FIG. 3), and the second fluid inlet 52 is the same as the previous embodiment in that it is connected to the other side of the 1-1 header in the first direction, but unlike the previous embodiment, in the present embodiment, the fluid inlet 50 is not connected to the second header row 20.

In the case of the present embodiment, the fluid flowing into the first header row 10 passes through through-holes 11*a* and 21*a* (see FIG. 3) formed between the 1-1 header 11 and the 2-1 header 21 (see FIG. 3), to partially rise, and then flows to the 1-2 header 13 and the 2-2 header 23 through the first and second connecting tubes 12 and 22. In this case, the fluid is supplied from both sides in the first direction and may thus pass through the first and second connecting tubes 12 and 22 in a high temperature state, thereby increasing heat exchange efficiency.

As set forth above, according to an embodiment, an evaporative condenser having improved heat exchange efficiency through the above configuration may be provided.

While example embodiments have been illustrated and described above, it will be apparent to those skilled in the art that modifications and variations could be made without departing from the scope of the present disclosure as defined by the appended claims.

What is claimed is:

1. An evaporative condenser comprising:

a first header row including a 1-1 header extending in a first direction and having a flow path therein, a 1-2 header extending in the first direction and having a flow path therein, and a plurality of first connecting tubes extending in a second direction between the 1-1 header and the 1-2 header and connecting the flow paths of the 1-1 header and the 1-2 header;

a second header row including a 2-1 header extending in the first direction and having a flow path therein, a 2-2 header extending in the first direction and having a flow path therein, and a plurality of second connecting tubes extending in the second direction between the 2-1 header and the 2-2 header and connecting the flow paths of the 2-1 header and the 2-2 header; and a third header row including a 3-1 header extending in the first direction and having a flow path therein, a 3-2 header extending in the first direction and having a flow path therein, and a plurality of third connecting tubes extending in the second direction between the 3-1 header and the 3-2 header and connecting the flow paths of the 3-1 header and the 3-2 header, wherein the first to third header rows are stacked in a third direction, the first to third directions are orthogonal to each other, the 1-1 header is provided with a plurality of fluid inlets connected to a fluid supply unit, wherein the plurality of fluid inlets include a first fluid inlet and a second fluid inlet, wherein the first fluid inlet is provided on one end of the 1-1 header in the first direction, and the second fluid inlet is provided on the other end of the 1-1 header in the first direction, wherein the evaporative condenser includes a first baffle plate disposed across the 1-1 header and the 2-1 header, between the first fluid inlet and the second fluid inlet, wherein the first baffle plate includes a first through-hole disposed in a position corresponding to the 1-1 header and a second through-hole disposed in a position corresponding to the 2-1 header.

2. The evaporative condenser of claim 1, wherein the first through-hole has a cross-sectional area smaller than a cross-sectional area of the 1-1 header, and the second through-hole has a cross-sectional area smaller than a cross-sectional area of the 2-1 header.

3. The evaporative condenser of claim 1, wherein the first baffle plate is disposed to be spaced apart from the first fluid inlet and the second fluid inlet by the same distance.

4. An evaporative condenser comprising:

a first header row including a 1-1 header extending in a first direction and having a flow path therein, a 1-2 header extending in the first direction and having a flow path therein, and a plurality of first connecting tubes extending in a second direction between the 1-1 header and the 1-2 header and connecting the flow paths of the 1-1 header and the 1-2 header;

a second header row including a 2-1 header extending in the first direction and having a flow path therein, a 2-2 header extending in the first direction and having a flow path therein, and a plurality of second connecting tubes extending in the second direction between the 2-1 header and the 2-2 header and connecting the flow paths of the 2-1 header and the 2-2 header; and a third header row including a 3-1 header extending in the first direction and having a flow path therein, a 3-2 header extending in the first direction and having a flow path therein, and a plurality of third connecting tubes extending in the second direction between the 3-1 header and the 3-2 header and connecting the flow paths of the 3-1 header and the 3-2 header, wherein the first to third header rows are stacked in a third direction, the first to third directions are orthogonal to each other, the 1-1 header is provided with a plurality of fluid inlets connected to a fluid supply unit, wherein the 1-1 header and the 2-1 header are configured to communicate with each other, the 1-2 header, the 2-2 header, and the 3-2 header are configured to communicate with each other, the plurality of fluid inlets include a first fluid inlet and a second fluid inlet, the first fluid inlet connects one end of the 1-1 header and the 2-1 header in the first direction to the fluid supply unit, and the second fluid inlet connects the other ends of the 1-1 header and the 2-1 header in the first direction to the fluid supply unit.

5. An evaporative condenser comprising:

a first header row including a 1-1 header extending in a first direction and having a flow path therein, a 1-2 header extending in the first direction and having a flow path therein, and a plurality of first connecting tubes extending in a second direction between the 1-1 header and the 1-2 header and connecting the flow paths of the 1-1 header and the 1-2 header;

a second header row including a 2-1 header extending in the first direction and having a flow path therein, a 2-2 header extending in the first direction and having a flow path therein, and a plurality of second connecting tubes extending in the second direction between the 2-1 header and the 2-2 header and connecting the flow paths of the 2-1 header and the 2-2 header; and a third header row including a 3-1 header extending in the first direction and having a flow path therein, a 3-2 header extending in the first direction and having a flow path therein, and a plurality of third connecting tubes extending in the second direction between the 3-1 header and the 3-2 header and connecting the flow paths of the 3-1 header and the 3-2 header, wherein the first to third header rows are stacked in a third direction, the first to third directions are orthogonal to each other, and the 1-1 header is provided with a plurality of fluid inlets connected to a fluid supply unit, wherein the 1-1 header and the 2-1 header are configured to communicate with each other, and the 1-2 header, the 2-2 header, and the 3-2 header are configured to communicate with each other, the evaporative condenser further comprising a fourth header row including a 4-1 header extending in the first direction and having a flow path therein, a 4-2 header extending in the first direction and having a flow path therein, and a plurality of fourth connecting tubes extending in the second direction between the 4-1 header and the 4-2 header and connecting the flow paths of the 4-1 header and the 4-2 header, wherein fluid flow directions in the first connecting tube and the second connecting tube are the same, and a fluid flow direction in the third connecting tube is opposite to a fluid flow direction in the first connecting tube, wherein the 3-1 header is configured to communicate with the 4-1 header for only one section in the first direction, and on the 4-1 header, a second baffle plate is disposed to divide the one section from other section.

6. The evaporative condenser of claim 5, wherein the second baffle plate is disposed on the 3-1 header, and includes a third through-hole having a cross-sectional area smaller than a cross-sectional area of the 3-1 header in a position corresponding to the 3-1 header.

7. The evaporative condenser of claim 6, wherein the second baffle plate is disposed biased to one side in the first direction in the 4-1 header such that a length of a portion communicating with the 3-1 header is longer than a length of the other portion.

8. The evaporative condenser of claim 7, wherein the other section of the 4-1 header is connected to a fluid outlet.

* * * * *